United States Patent [19]

Gomez et al.

[11] 4,231,199

[45] Nov. 4, 1980

[54] METHOD AND COMPONENTS FOR CONSTRUCTION OF BUILDING FROM CONCRETE SLABS

[76] Inventors: Nicolas Q. Gomez; Raul Martin, both of P.O. Box 8157, Santurce, P.R. 00910

[21] Appl. No.: 876,177

[22] Filed: Feb. 8, 1978

Related U.S. Application Data

[63] Continuation of Ser. No. 717,684, Aug. 25, 1976, abandoned.

[30] Foreign Application Priority Data

Aug. 26, 1975 [DO] Dominican Republic ..... 2313

[51] Int. Cl.[2] ..... E04B 7/04; E04B 1/04

[52] U.S. Cl. ..... 52/91; 52/92; 52/204; 52/251; 52/264; 52/285; 52/396; 52/745; 52/747; 52/748

[58] Field of Search ..... 52/91, 92, 250, 251, 52/284, 285, 394, 396, 574, 602, 583, 745, 747, 748, 264, 204

[56] References Cited

U.S. PATENT DOCUMENTS

| | | | |
|---|---|---|---|
| 1,369,294 | 2/1921 | Painter | 52/250 X |
| 1,392,532 | 10/1921 | Simpson | 52/91 |
| 2,105,854 | 1/1938 | Buck | 52/91 |
| 2,129,369 | 9/1938 | Faber | 52/609 |
| 2,235,001 | 3/1941 | Allen | 52/601 X |
| 2,331,083 | 10/1943 | Smith | 52/91 |
| 2,594,928 | 4/1952 | Horowitz | 52/284 |
| 2,969,619 | 1/1961 | Didrick | 52/285 |
| 3,197, 933 | 8/1965 | Burns et al. | 52/538 |
| 3,279,135 | 10/1966 | Jacobsen | 52/583 |
| 3,423,891 | 1/1969 | Burris | 52/92 X |
| 3,735,549 | 5/1973 | Shuart | 52/583 X |
| 3,952,471 | 4/1976 | Mooney | 52/745 |

FOREIGN PATENT DOCUMENTS

| | | | |
|---|---|---|---|
| 528437 | 8/1921 | France | 52/587 |
| 409211 | 2/1945 | Italy | 52/234 |
| 716564 | 10/1966 | Italy | 52/574 |
| 67677 | 4/1944 | Norway | 52/574 |

*Primary Examiner*—Alfred C. Perham
*Attorney, Agent, or Firm*—Penrose Lucas Albright

[57] ABSTRACT

A plurality of modular reinforced concrete panels of a generally uniform coacting design having overlapping edges are sequentially arranged in relation to each other upon a reinforced concrete slab to provide an efficient economical building structure. The building is thus constructed with unskilled labor in a relatively short period of time.

25 Claims, 10 Drawing Figures

FIG. 5
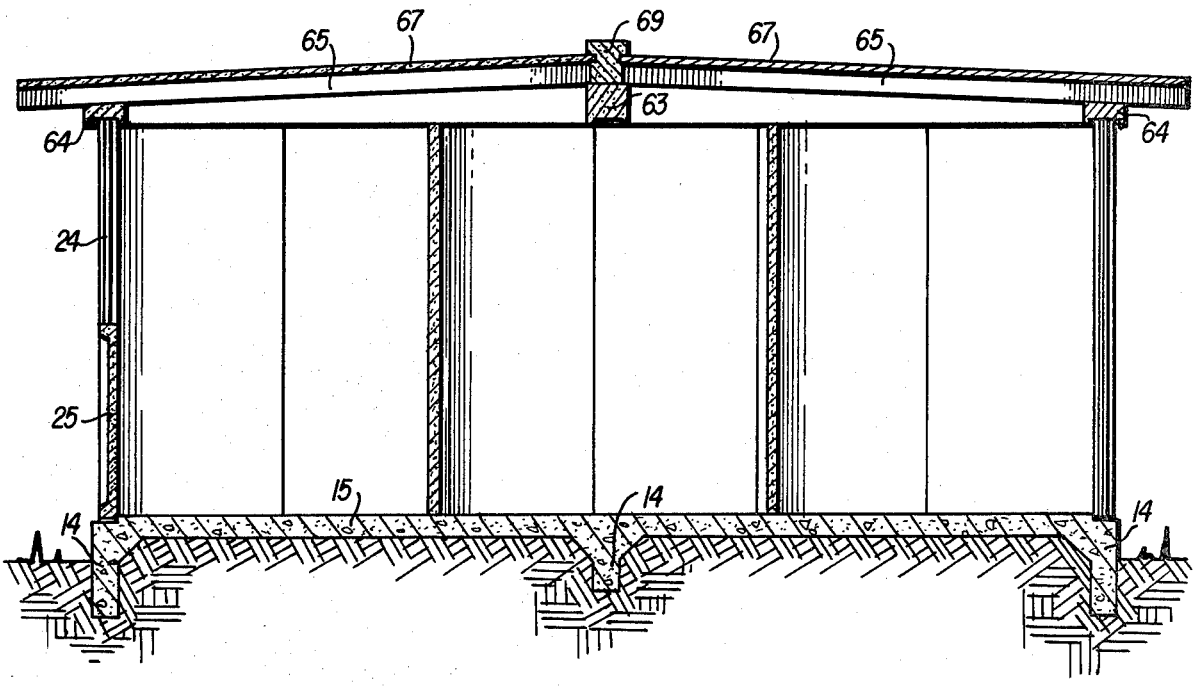
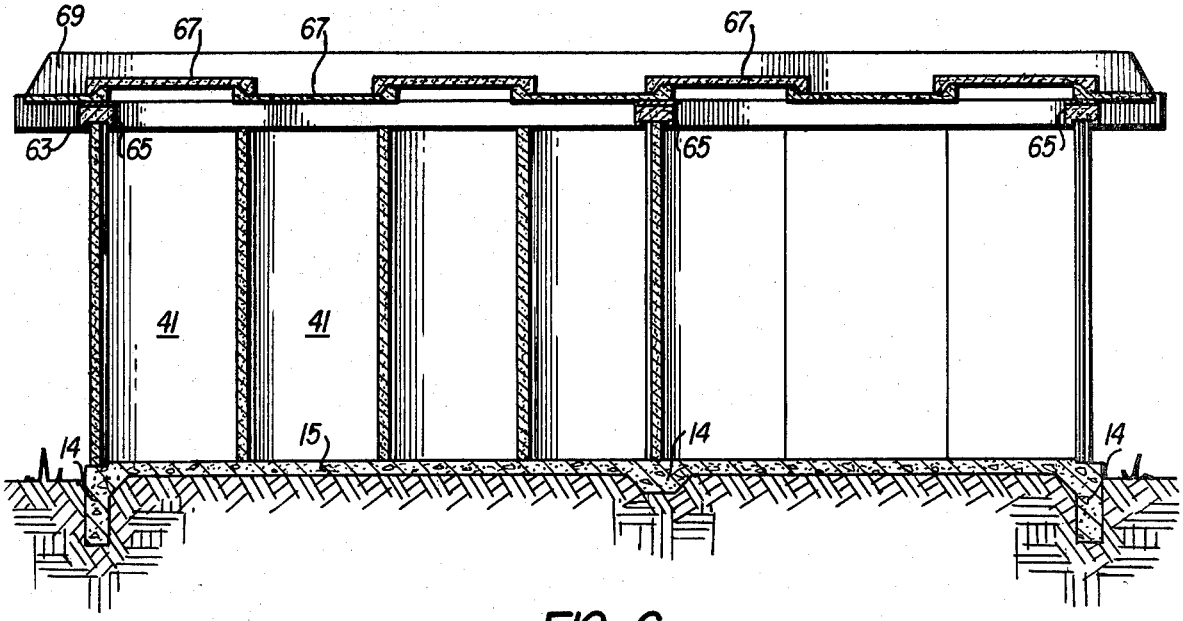
FIG. 6

METHOD AND COMPONENTS FOR CONSTRUCTION OF BUILDING FROM CONCRETE SLABS

RELATED APPLICATION

This is a continuation of application Ser. No. 717,684 filed Aug. 25, 1976 now abandoned.

BACKGROUND OF THE INVENTION

In many areas throughout the world people live in houses that are far below desirable standards. Thatched huts are common-place in underdeveloped countries. These frequently comprise little more than a few tree poles tied together and covered with available thatch. The floors of such huts are usually dirt and the walls may be thatch or earthen.

Health organizations deplore such living conditions and express a need for a building structure that is both economical to construct and within the technological development of these countries; yet is sufficiently substantial to withstand winds of hurricane force, to be waterproof against torrential rains, and to resist earthquakes.

Further, there is a continuing need for a modular element having versatility in use to create building structures of varied size and configuration and at low cost.

FIELD OF THE INVENTION

Our invention contemplates the use of a plurality of specially designed cooperating modular reinforced concrete panels. These panels, when properly assembled, are provided with wedge-shaped vertical side edges which interlock with those of adjacent panels and thereby form a substantially tight weatherproof wall. Entrances, such as doorways, are of the same modular dimensions. To provide window openings, an upper window portion and a lower smaller panel are combined to comprise the same modular dimensions. Interior walls are also made from the same modular panels, with panels eliminated where it is desired to provide an accessway or a doorway. Likewise the roof comprises a plurality of the same type interlocked modular panels, but here of greater length.

It will be appreciated that these reinforced concrete modular panels are readily precast at a central location and transported to the construction site as needed. Alternatively, the apparatus for producing the panels and other structure may be transported to the building site. The configuration and size of the resulting building is conveniently modified by adding or subtracting panels. The use of metal in connecting the panels is largely eliminated.

DESCRIPTION OF THE PRIOR ART

A U.S. Pat. No. 2,129,369, issued Sept. 6, 1938 to Faber discloses a prefabricated masonry block of a configuration which affords interlock with other similar blocks to form, with the use of mortar, vertical load sustaining walls. In a further U.S. Pat. No. 2,594,928, issued Apr. 29, 1952 to Horowitz, the use of slabs as a covering material over a previously constructed brick or steel building is disclosed. Another U.S. patent to Burns et al, U.S. Pat. No. 3,197,933, issued Aug. 3, 1965 relates to interlocked concrete decking channel channel members. Still further, building blocks of interlocking configuration, are taught in a U.S. Pat. No. 3,418,774, issued Dec. 31, 1968, to Kocher et al.

In the U.S. patent to Allen, U.S. Pat. No. 2,235,001 of Mar. 18, 1941, a simple and inexpensive method of manufacturing concrete wall panels by unskilled labor is disclosed. A building panel useful for providing a finished exterior wall surface for buildings is described in the U.S. patent to Rowe, U.S. Pat. No. 3,245,185 of Apr. 12, 1966. In a further U.S. Pat. No. 2,969,619 of Jan. 31, 1961, the inventor, Didrick, discloses concrete panels for wall, partition and roof units, and means for interconnecting same to form the completed building. The design of further wall panel units is discussed in U.S. Pat. No. 2,703,003 of Mar. 1, 1955. Various prefabricated wall and roof units of interest are disclosed in U.S. Pat. No. 3,484,999 of Dec. 23, 1969 issued to Van der Lely. Further prior art of pertinence includes the references cited in the prosecution of each of the foregoing mentioned patents and Class 52 of the U.S. Patent Office Classifications of U.S. and foreign references, particularly subclasses 79 and 601.

SUMMARY OF THE INVENTION

A plurality of modular panels are assembled upon a concrete floor slab of desired size and configuration. These panels interlock with each other and with the floor slab. Beams are placed upon the upper edges of the panels to provide for the further interlocking and to provide mounting means for the roof panels. The building structure comprises an assembly of modular panels which are held together by their integrated configuration and by a plurality of holding bolts, pins or the like. With this arrangement it has been found that it is not necessary to bond the panels together by the use of mortar or other cementitious material. The interlocked relation is sufficient to provide structural strength for maintaining the building in erect condition and to provide a substantial holding relation between panels.

BRIEF DESCRIPTION OF THE DRAWINGS

FIG. 5 is a side sectional elevation of the assembled building;

FIG. 6 is a front sectional elevation of the assembled building which also illustrates the floor slab and footings;

DESCRIPTION OF THE PREFERRED EMBODIMENT

As has been previously stated, an important aspect of this invention lies in the provision of a modular, rectangular panel which may be mass produced at a convenient central location. The requisite number of panels may then be shipped to the construction site or manufactured on site by portable equipment and readily assembled by substantially unskilled labor. These panels are utilized for both the interior and exterior vertical walls of a building, as well as for the roof members. The panels are of steel rod reinforced concrete, which is well known throughout the building trades. The specific length and width of the panel is, within limits, a matter of choice, however, it has been found advantageous that one dimension be a multiple of the other. Thus vertical wall panels are preferably about two or three times as long as they are wide.

Figure 1:
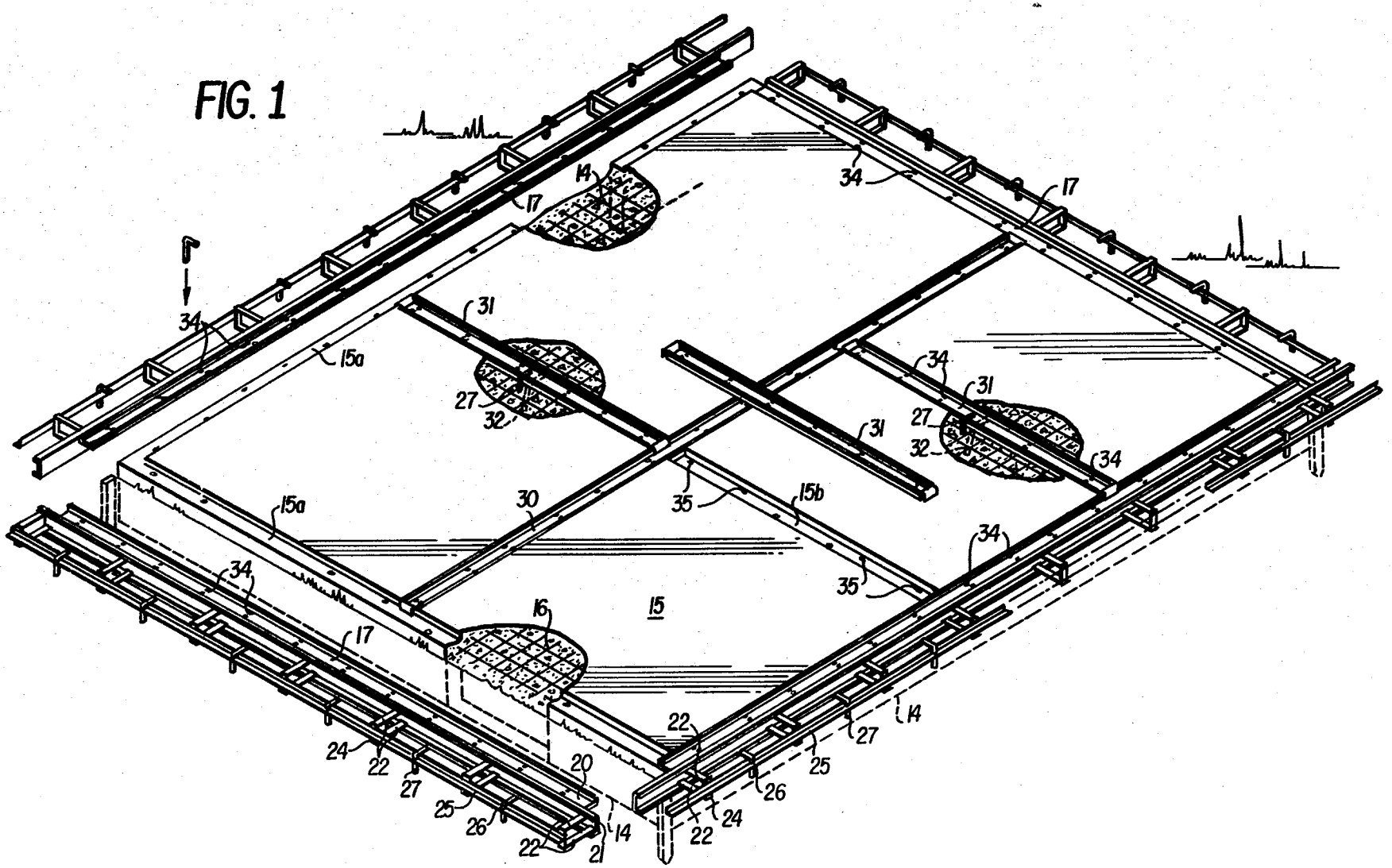
FIG. 1 is an isometric view which illustrates the foundation slab and sequence of steps for casting the concrete for slab.

Referring now to FIG. 1, the site for the building is first surveyed, staked and then leveled. Thereafter the necessary excavations or ditches are provided for the footings 14, for the slab 15. However, before the slab 15 is poured, steel reinforcement 16 is placed in position with the assistance of four peripheral mold parts 17. Each mold part 17 comprises two shallow channel beams 20 and 21 which are welded together at right angles to form an upper horizontal member and a lower vertical member respectively. Each channel beam 21 has welded to its upper and lower limbs a plurality of struts 22 which are welded together away from channel beam 21 by a cross piece 24, a series of which for each mold part 17 have welded thereto an angle iron 25 which extends parallel to the channel beams 20 and 21. A plurality of spaced openings 26 are provided in the horizontal limb of the angle iron 25 each of which receives a spike 27 which has its head bent to a horizontal position as shown.

It will be appreciated that when the mold parts 17 are placed in position for pouring the slab that the channel beams 20 and 21 extend over the excavation for the footings 14. The struts 22, angle iron 25 and spikes 27 (which are caused to be driven into the earth) thus stabilize and position the mold parts 17 which, particularly the side mold parts, might otherwise topple into the excavation or otherwise be dislocated.

With the mold parts 17 in position, a center templet 30 is positioned between the side mold parts 17 and at right angles thereto, and crosstemplets 31 are also appropriately located. The templets 30 and 31 as well as the reinforcment 16 are spaced above the underlying surface by chairs 32 in a manner well known to the art. Further, spikes 27 may also be utilized for the same purpose.

It will be noted that each of the channel beams 20, the center templet 30 and the cross templet 31 have a plurality of openings 34. Selected of such openings receive and position galvanized pipe studs 35 which are each cylindrical in form and adapted to be filled with an expanding mortar 36 which subsequently receives a threaded rod 37 having the same longitudinal axis as the corresponding stud 35. The top of each stud 35 is at the same level as the undersurface of channel beam 20 or templets 30 or 31 as appropriate. Not every opening 34 is utilized to receive a stud 35, but rather studs 35 are provided alternately by sets of two's as illustrated with reference to the templet 31 illustrated in a raised position in FIG. 1.

With studs 35 in place, concrete is poured to form slab 15 and footings 14 in a manner well known to the art. Preferably, prior to the pouring and after preparing the necessary leveling and excavation of the site, a waterproof material such as polyethelene is provided whereby it underlies the resulting slab and surrounds the footings. A layer of such material is thus interposed between the resulting slab and footings and the underlying and supporting soil.

From two to four hours after the slab and footings have been poured, the mold parts and templets are removed and the slab is permitted to cure. After slab 15 has satisfactorily cured, a building is constructed thereon as will be hereinafter described.

Figure 2:
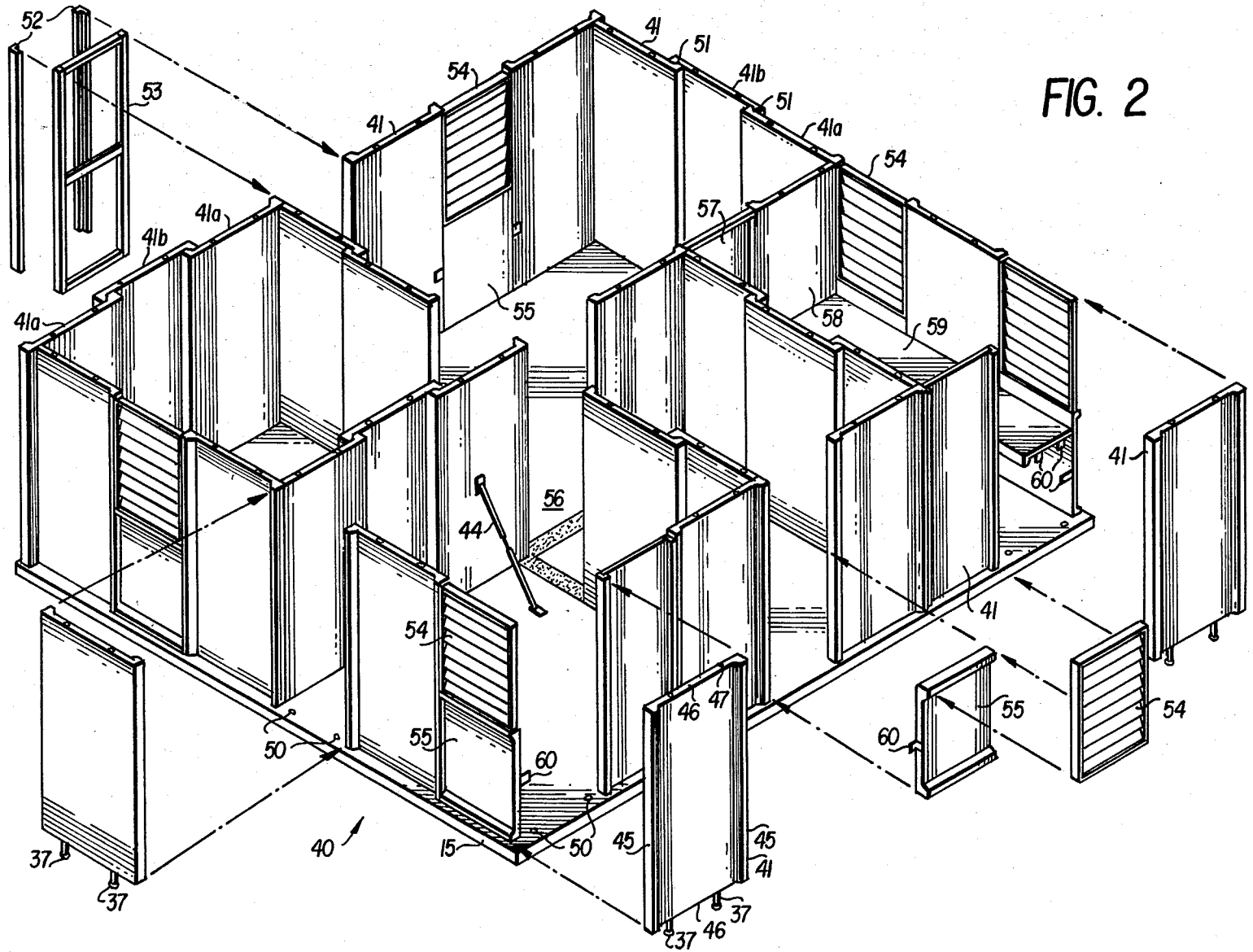
FIG. 2 is an isometric view of the assembled building structure with the roof parts removed and certain parts shown in exploded relation.

In FIG. 2 the building designated generally by reference numeral 40 comprises a plurality of rectangular panels 41 mounted upon the precast reinforced concrete slab 15. These panels are plumbed and temporarily braced, as by brace 44, until they are fully assembled.

Each panel 41 is rectangular and, as indicated above, twice as long as it is wide, and provided on each of its longer edges with a raised portion 45 of trapezoidal configuration. The raised portions are of substantially twice the thickness of the remainder of the panel. The shorter edges 46 are provided with spaced holes 47 for the reception of threaded rods 37 the purpose of which will become apparent as the specification progresses. The reinforced concrete slab 15 with the footings 14, is, as previously indicated, cast in situ after appropriate clearing and leveling of the construction site. The slab, when cast, includes rod receiving apertures 50 (the interior bores of studs 35) appropriately disposed over the entire surface area thereof to establish the positioning of the interior and exterior wall panels. Apertures 50 are formed adapted to receive rods 37.

A significant feature of this invention lies in the sequence of assembly of the vertical panels. Considering one wall, and starting from a corner, each alternate panel, i.e. the first, third, fifth, etc., comprising a first group, is erected level and plumb. Each of these panels is erected with the raised trapezoidal portions facing the same direction, for example, outwardly. The lower rods 37 extending from the bottom of each panel 41 are disposed in the apertures 50 in the concrete slab received and encased by still plastic mortar 36 previously introduced into the interior of studs 35. Subsequently, the intermediate panels, i.e., the second, fourth, sixth, etc., are similarly erected level and plumb. It will be noted, however, that these intermediate panels are disposed with their raised trapezoidal portions also facing the same direction, but in a direction opposite to that of the first group of panels, in this case, inwardly. This relationship may be seen in the disposition of the panels designated 41*a*, 41*b*, in FIG. 2. Further, the trapezoidal portions of the intermediate panels overlap those of the first group, as is shown at juncture 51. Some panels at intersections, for example panel 41*c*, may optionally be provided with a single trapezoidal edge only. Where it is desired to provide an access opening for a doorway or a window, the corresponding panel is omitted. The wooden door frame members 52 and the door 53 are of a combined width whereby they properly fill the space of the omitted panel. Windows 54 are of the width of the aperture of the omitted panel, but cover only the upper half of the space. The lower half is filled by a half panel 55. This half panel is produced by cutting a whole panel and rotating the half panel 90° so that the trapezoidal portions serve as a sill and a supporting base.

Interior partitioning walls are similarly provided by the overlapped panels as is clearly illustrated in FIG. 2. As previously stated, the lower edge of each panel is provided with rods 37 which fit into apertures 50 in slab 15. In the interest of economy, interior accessways are merely left open, as, for example, passage 56. It is obvious, however, that, if desired, a complete door and frame may be installed. Thus a door 57 is provided for the entry to kitchen 58 having a table 59 which is fastened to the wall by metal cleats 60. Cleats 60 are also utilized for holding others elements to the wall, such as the half panels below the windows.

Figure 3:
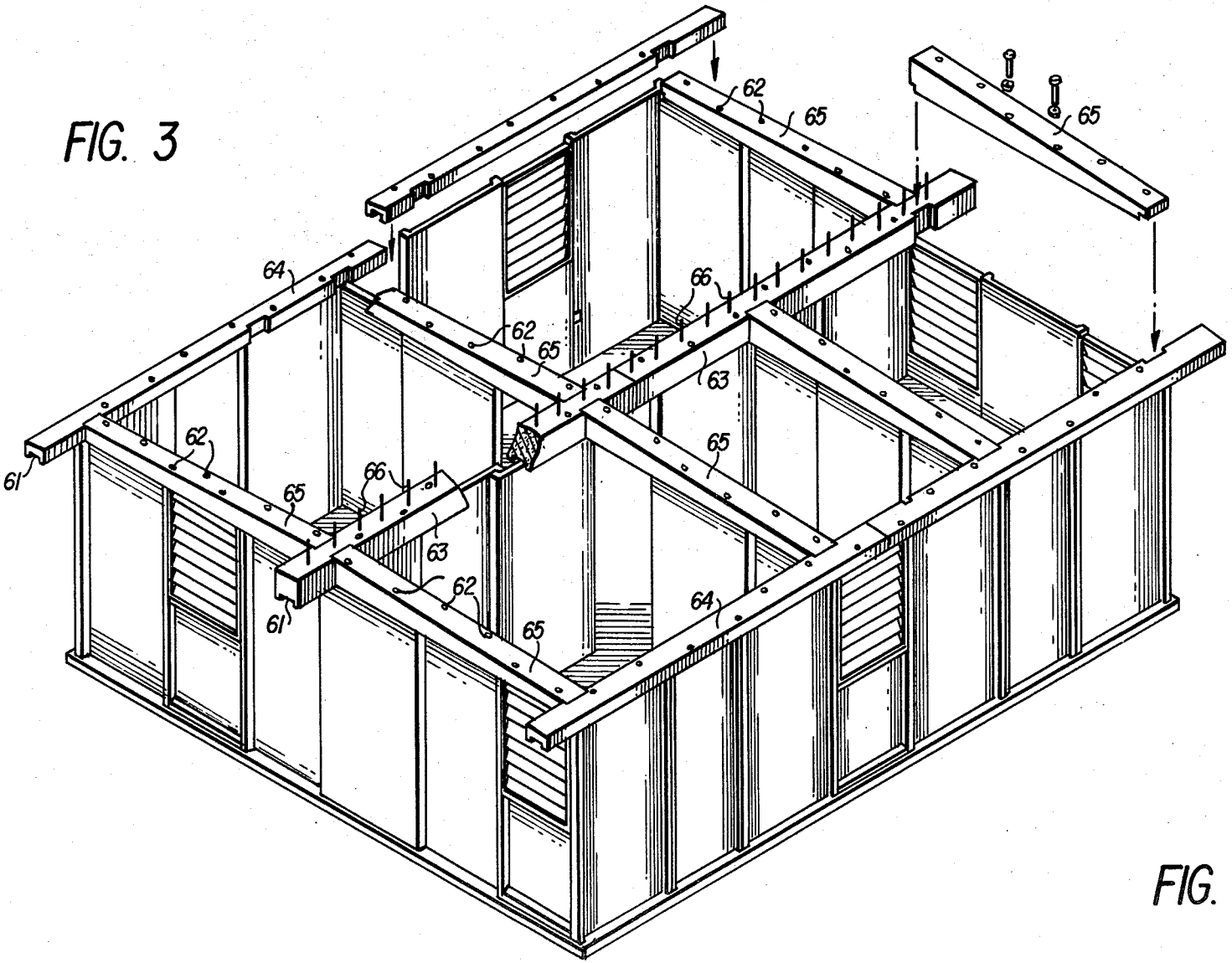
FIG. 3 is an isometric view illustrating the roof beam members and their relationship to the vertical panels.

FIG. 3 illustrates the roof beams which not only provide mounting means for the roof itself, but also complete the assembly of the vertical interior and exterior panels. The several beams are reinforced concrete and are provided with channels 61. These channels are of a depth and width to accommodate and embrace the upper ends of the wall panels. The beams are provided with a series of apertures 62 which, when assembled, coincide with the apertures 47 in the upper aspects of the panels. When properly aligned, anchoring bolts 48 having washers 49 are received in both sets of apertures to prevent any shifting of the components. The center beam 63 is of substantially greater thickness than the outer beams 64, for a reason which will be presently noted. Tapered transverse beams 65 extend from the center beam to the outer beams. Extending vertically from the center beam and along the entire length thereof are a series of fastening means 66 comprising reinforcement rods with their lower portions encased in beam 63.

Figure 4:
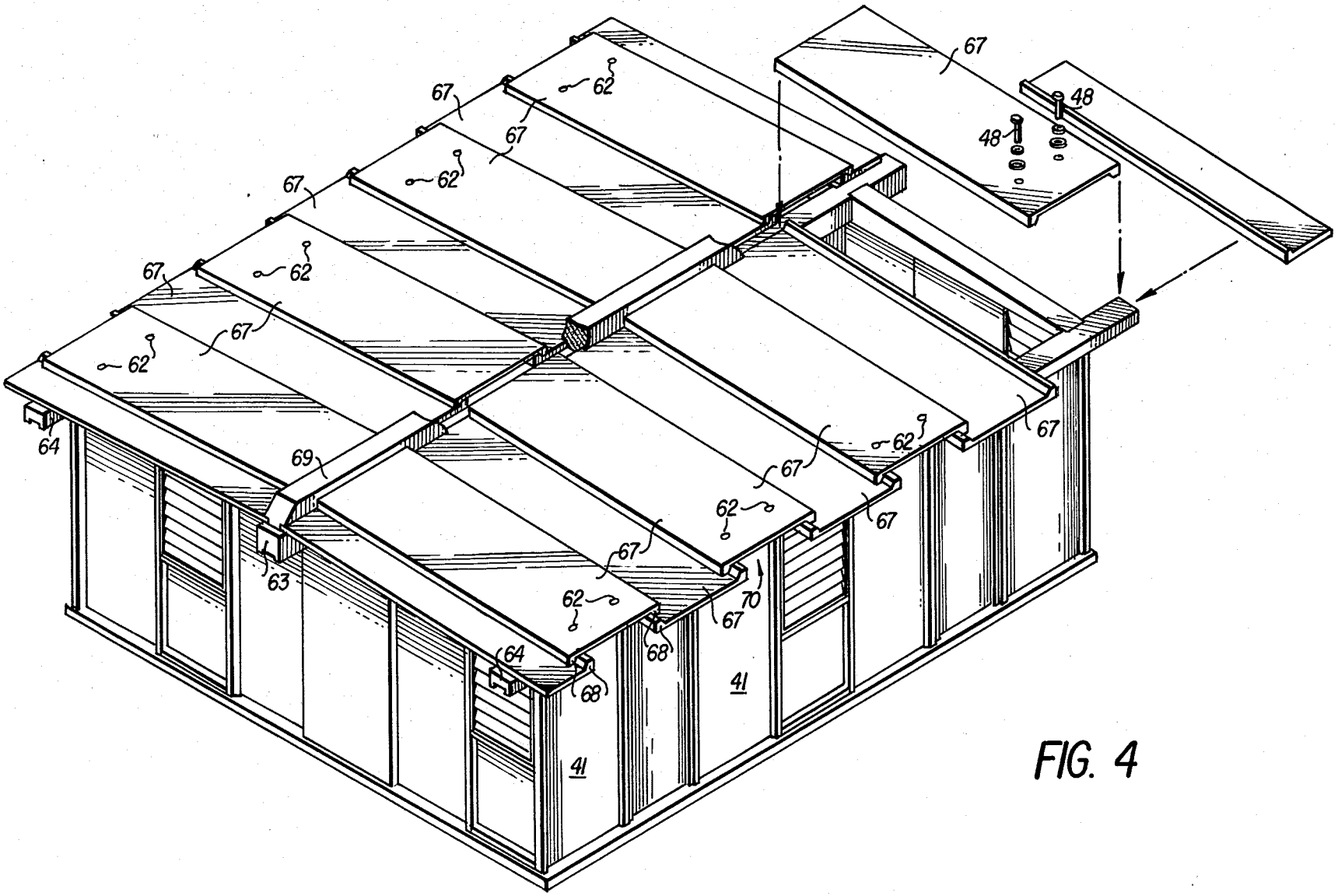
FIG. 4 illustrates in an isometric view the roof in place on top of the vertically disposed panels and the overhanging eaves.

The roof is completed by the placement of roof panels 67 which extend from the center beam to the outer beam. These panels 67 are similar to but longer than the panels 41. Their long edges are trapezoidal as at edge portion 68 and the panels are installed in a sequence similar to that described for the vertical wall panels. It can be seen from FIGS. 3 and 4 that connections of the panels 67 to the center beam 63 and the side beams 64 provide an inclined pitch which readily sheds water and that the overlapped trapezoidal edges effectively seal against leakage into the interior. The upper edges of the panels on both sides of the center beam are sealed by a bridging cap member 69 which is cast in place receiving rods 66. Prior to such casting precast slabs **69*a* and 69*b* support the panels 67 with centrally reinforced rods 66*a* and 66*b* extending inwardly from slabs 69*a* and 69*b*, respectively, to become encased in member 69. The portions of the panels extending beyond the outer beams 64 provide an effective protective eaves structure 70**.

Figure 10:
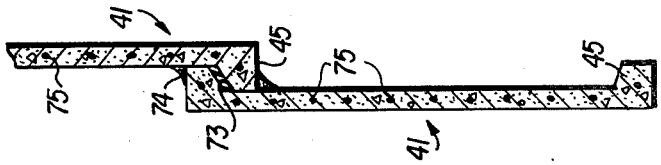
FIG. 10 is a sectional view of two wall panels showing the seam seal, calking, and reinforcing rods.

The junction between exterior wall panels 41 is completely sealed by the use of a rubber gasket member comprising strip 73 pressurized into place and then caulked at the exterior connection with a waterproof caulking 74 (FIG. 10). Reinforcing rods 75 extend through the panels and the slab in a manner well known in the art. The panels are preferably reinforced with crisscrossed steel rods.

Inasmuch as the configuration and size of the building may be varied according to the situation existing at the job site, as previously outlined, it is necessary to cast the floor slab and the several beams at job site.

The manner in which the panels are tied to each other and to the slab and roof provides a structure which safely withstands winds of hurricane force, as well as earthquake shocks. When completely assembled, all brace members such as 44 are removed and, if desired, the concrete surfaces may be painted.

Figure 9:
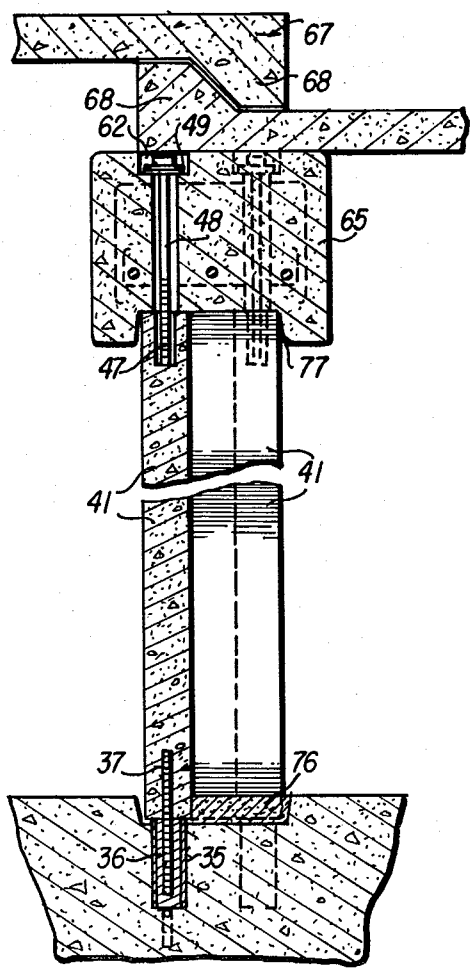
FIG. 9 is a view similar to FIG. 8 showing a roof and a cross-beam and cross-section together with the means for supporting same via a wall panel.
Figure 8:
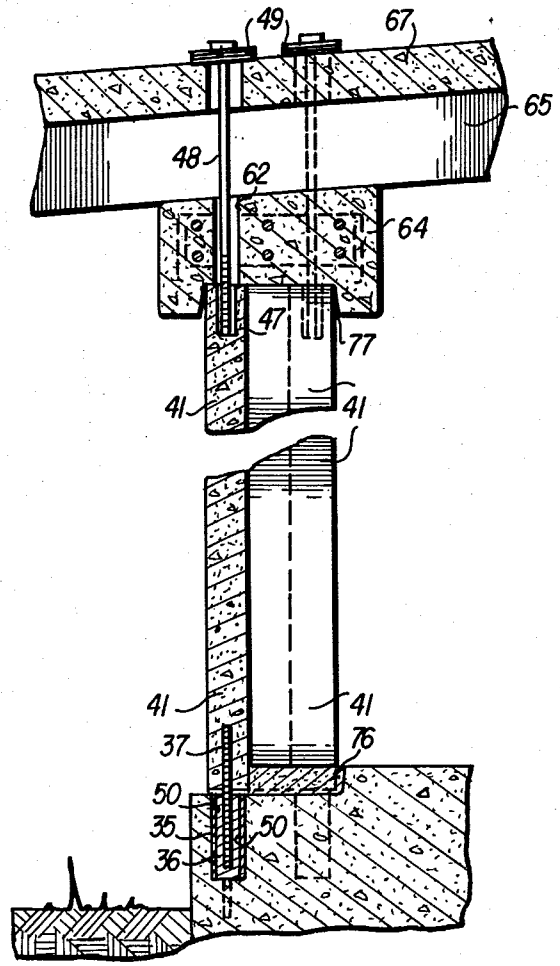
FIG. 8 is a further detail illustrating a side longitudinal beam which carries the edge of the roof and a support for such beam via wall panel and its connection to the floor slab.
Figure 7:
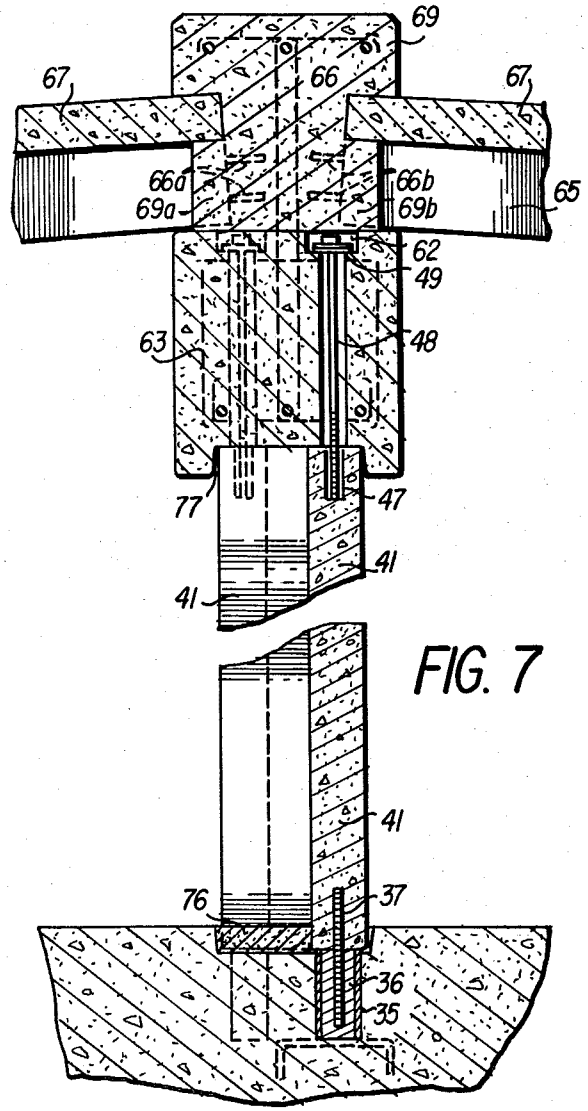
FIG. 7 is a detailed view in section of the center beam of the building and its support.

To assist in establishing a rigid connection between slab 15 and panel 41, mortar 76 is placed in the depression **15*a* formed by channel beam 20 in the casting of slab 15 and other depressions in the slab such as depression 15*b* molded by templet 31. Mortar 76 encases the lower end of panels 71 and, preferably, is level with the upper surface of slab 15. If desired, further mortar may be provided to encase the tops of panels 41 in channels 61 at locations 77** (FIGS. 7–9).

Although we have described the preferred embodiment of our invention, it is to be understood that it is capable of other adaptations and modifications within the scope of the appended claims.

Having thus described our invention, what we claim as new and desire to secure by Letters Patent of the United States is:

1. A single story building which comprises: a plurality of load-bearing walls each consisting of a plurality of pre-cast concrete load-bearing wall panels; said wall panels having substantially identical horizontal cross-sections and having substantially thicker portions in their vertical edges than between said portions; a substantially horizontal concrete framework which continuously defines on its lower side longitudinally disposed channels receiving the upper edges of said wall panels of said plurality of walls; said wall panels being assembled in an overlapping relationship and alternately offset relative to the longitudinal horizontal centerline of said wall in which they are contained and overlapping with adjacent wall panels in the same wall whereby a vertical plane may be received in each said wall of the building whereby said wall panels are alternately spaced from said plane except at said vertical edge portions which are overlapping, said edge portions of all said wall panels being intersected by said plane; a substantially horizontal floor slab which continuously defines recesses in its upper side, said recesses being spaced vertically directly under and corresponding to said channels, said wall panels having their lower edges secured to said floor slab in said recesses and their upper edges secured to said framework in said channels; a roof secured on top of said concrete framework; said recesses and said channels for each corresponding wall comprised of wall panels secured therein continuously receiving said vertical plane for said corresponding wall; said roof and said framework being substantially entirely supported from said slab by said wall panels.

2. A building in accordance with claim 1, wherein each said wall panel comprises a quadrilateral reinforced concrete panel having a coplanar surface and a pair of opposed surfaces adjacent the periphery of said panel, one said opposed surface being disposed on each side of said coplanar surface, only said pair of opposed surfaces being provided with integral raised concrete peripheral portions extending through said plane, and means including said raised peripheral portions being disposed along all four peripheral edges of said panel for connecting said panel to other of said wall panels, said framework and said floor slab, said raised peripheral portions being trapezoidal in cross-section with the facing surfaces thereof, diverging outwardly relative to said coplanar surface.

3. A building according to claim 2, wherein said raised peripheral portions are disposed along parallel edges of said opposed surface.

4. A building according to claim 3, wherein said raised peripheral portions extend along substantially the entire lengths of said parallel edges, said wall panels having substantially uniform cross-sections throughout.

5. A building according to claim 1, wherein said wall panel is a rectangle and raised peripheral portions are disposed along only the longer peripheral edges of each said rectangular panel, the length of each said panel's longer side being substantially a multiple by an integer of the width of such panel's shorter side.

6. A building according to claim 1, wherein said roof is comprised of further panels, said wall panels and roof panels each comprising elements of similar construction, each such element comprising a rectangular panel of reinforced concrete, each said rectangular panel having a planar surface and being provided with raised concrete portions of trapezoidal cross-section at opposed surfaces adjacent said planar surface along said panel's longer peripheral edges, means other than raised concrete portions along the shorter peripheral edges of said rectangular panel for connecting said rectangular panel to other diverse construction components, said rectangular panels being disposed in overlapped relationship to each other whereby the inclined surfaces of the raised trapezoidal portions on one said rectangular panel abut the inclined surfaces of the raised trapezoidal portions on the next succeeding said rectangular panel and areas of said opposed surfaces thereby overlap.

7. A building according to claim 6, wherein said floor slab means has fastening means for said wall panels embedded therein, said raised portions on said wall panels extending substantially vertically and some of said connecting means on said wall panels being connected to said fastening means in said slab.

8. A building according to claim 7, wherein said fastening means in said floor slab are positioned in said recesses at selected locations whereby when said wall panels are fastened thereto, exterior and interior wall structures are provided.

9. A building according to claim 8, wherein selected exterior and interior panels in said wall structure are spaced apart to provide access means, the vertical boundaries of said access means comprising a said raised portion on the adjacent of said wall panels.

10. A building according to claim 9, wherein door means are positioned in selected of said access means.

11. A building according to claim 9, wherein window means are disposed in selected of said access means.

12. A building according to claim 6, wherein said framework includes an upper centrally disposed concrete beam mounted therein, said roof panels being disposed in part on said upper beam in non-horizontal, water-shedding relationship to provide a roof.

13. A building according to claim 12, wherein said framework further comprises outer beams parallel to said center beam and disposed at a level higher than said outer beams.

14. A building according to claim 1, wherein said floor slab comprises a reinforced concrete slab, cast in situ, of predetermined density and configuration and including footing means, said recesses disposed in the matrix of said slab, stud means included in said recesses providing cooperative wall fastening elements determining the positioning and mounting of the interior and exterior of said wall panels.

15. A method of constructing a building comprising the steps of: casting a reinforced concrete floor slab having interior and exterior wall fastening means thereon; fastening exterior wall and interior wall forming panels thereto in a sequence where the panels in a first group are fastened spaced apart a distance sufficient to accommodate further panels of a second group in opposed, overlapped relations thereto; then fastening a second group comprising said opposed, overlapping panels to said slab; providing accessways in said exterior and interior walls; directly connecting said panels together along their upper edges by roof supporting beam members whereby each said beam member receives on its lower edge said upper edges of said panels of the corresponding directly underlying said wall; fastening roof forming panels to said beams in a sequence where a first group of said roof forming panels are fastened spaced apart a distance sufficient to accommodate a further group of roof forming panels in opposed overlapped relation thereto; then fastening said further group of opposed, overlapped roof forming panels to said beams.

16. A method according to claim 15, and the step of further providing a waterproof seal along the overlapped junctures of said exterior wall forming panels.

17. A method according to claim 15, and the step of further providing closure doors in selected access ways and windows in selected access ways.

18. A method according to claim 15, and the step of further providing downwardly inclining said roof forming panels from a point adjacent the longitudinal centerline of said building to a point adjacent said outer walls thereof and applying a waterproof seal to said panels at the longitudinal centerline ends thereof.

19. A method in accordance with claim 15, comprising pairs of adjoining slabs, each slab comprising a coplanar area and an edge of trapezoidal cross-section, said edge including an interior inclined portion having an obtuse angular relationship with said coplanar area, said edges being placed in parallel overlapping relationship whereby said inclined portions of adjacent slabs are brought into juxtaposition.

20. A method as set forth in claim 19, wherein said slabs are vertically disposed wall slabs, a horizontal beam with a slot along its underside being placed whereby it is continuously receiving the tops of said slabs.

21. A method in accordance with claim 19, wherein said slabs comprise an inclined roof, said slabs being supported by a center beam which includes a portion wherein the ends of said slabs are cast and thereby encased in said beam.

22. A method in accordance with claim 19, wherein said obtuse angle is about 135°.

23. A single story building which comprises: a plurality of load-bearing walls each consisting of a plurality of precast concrete load-bearing wall panels of substantially uniform horizontal cross-section which have vertical edge portions which are thicker than the thickness of said wall panels between said edge portions; a substantially horizontal concrete framework which continuously defines on its lower sides longitudinally disposed means receiving the upper edges of said wall panels of said plurality of walls; said wall panels being assembled with said vertical edge portions in an overlapping relationship, said wall panels being alternately offset relative to longitudinal horizontal centerline of said wall in which they are contained and overlapping with adjacent wall panels in the same walls whereby a vertical plane may be received through each said wall of the building wherein said wall panels are alternately spaced from said plane except for said overlapping edge portions which all intersect said plane; a substantially horizontal floor slab which continuously defines receiving means on its upper side, said receiving means being spaced vertically under and corresponding to said longitudinally disposed means, said wall panels having their lower edges secured to said receiving means and their upper edges secured to said longitudinally disposed means; a roof secured on top of said concrete framework; said roof and said framework being substantially entirely supported from said slab by said wall panels.

24. A building in accordance with claim 23 wherein said roof is comprised of a plurality of overlapping roof panels which each include edge portions which are thicker than the thickness of said roof panel between said edge portions and have substantially the same cross-section perpendicular to said roof panel edge portions as said horizontal cross-section of said wall panels.

25. A building in accordance with claim 24, wherein each said roof panel edge portion contains throughout a vertical plane which also is contained throughout in at least one underlying wall panel edge portion.

* * * * *

UNITED STATES PATENT AND TRADEMARK OFFICE

CERTIFICATE OF CORRECTION

PATENT NO. : 4,231,199

DATED : November 4, 1980

INVENTOR(S) : NICOLAS QUINTANA GOMEZ ET AL

It is certified that error appears in the above-identified patent and that said Letters Patent are hereby corrected as shown below:

Cover Page, line 2, change "Gomez et al" to

- - Quintana et al - - ;

line 6, change "Nicolas Q. Gomez" to

- - Nicolas Quintana Gomez - - ;

between lines 8 and 9 insert - - [73]

Assignee: ARIES S.A., Santo Domingo, DOMINICAN REPUBLIC - -.

Signed and Sealed this

*Thirty-first* Day of *March 1981*

[SEAL]

*Attest:*

RENE D. TEGTMEYER

*Attesting Officer*

*Acting Commissioner of Patents and Trademarks*